US008523600B2

(12) United States Patent
Hosokawa et al.

(10) Patent No.: US 8,523,600 B2
(45) Date of Patent: Sep. 3, 2013

(54) ELECTRONIC DEVICE WITH A MOVABLE MEMBER THAT BENDS A WIRING AND PREVENTS FITTING OF ANOTHER CONNECTOR IN CERTAIN ARRANGEMENTS

(75) Inventors: Toshio Hosokawa, Anjo (JP); Yasuo Takemura, Sakura (JP); Yuji Ishitani, Sakura (JP)

(73) Assignees: Denso Corporation, Kariya (JP); Fujikura Ltd., Tokyo (JP)

( * ) Notice: Subject to any disclaimer, the term of this patent is extended or adjusted under 35 U.S.C. 154(b) by 257 days.

(21) Appl. No.: 12/807,499

(22) Filed: Sep. 7, 2010

(65) Prior Publication Data

US 2011/0060479 A1 Mar. 10, 2011

(30) Foreign Application Priority Data

Sep. 9, 2009 (JP) ..... 2009-208031

(51) Int. Cl.
*H01R 13/56* (2006.01)

(52) U.S. Cl.
USPC ..... 439/445

(58) Field of Classification Search
USPC ..... 439/445, 157–160, 358, 260, 492–499
See application file for complete search history.

(56) References Cited

U.S. PATENT DOCUMENTS 5,830,006 A 11/1998 Koumatsu et al.
6,036,529 A * 3/2000 Brown et al. ..... 439/445
6,283,504 B1 9/2001 Stanley et al.
6,378,900 B1 4/2002 Stanely et al.
6,392,542 B1 5/2002 Stanley
6,517,106 B1 2/2003 Stanley et al.
6,520,535 B1 2/2003 Stanley et al.
6,563,231 B1 5/2003 Stanley et al.
6,577,023 B1 6/2003 Stanley et al.

(Continued)

FOREIGN PATENT DOCUMENTS

DE 199 83 956 11/2009
JP H9-199220 7/1997

(Continued)

OTHER PUBLICATIONS

Office Action mailed Jan. 29, 2013 in corresponding Japanese Application No. 2009-208031 with English translation thereof.

(Continued)

*Primary Examiner* — Chandrika Prasad
(74) *Attorney, Agent, or Firm* — Harness, Dickey & Pierce, PLC

(57) ABSTRACT

An electronic device includes an electronic control unit, a wire, and a wiring-side connector. When a movable member is arranged in a first arrangement relative to a wiring-side connector main body, the movable member is in a position where the movable member does not prevent the wire from projecting from the main body to extend straight in a counter-fitting direction. When the movable member rotates from the first arrangement to a second arrangement relative to the main body, a restricting member approaches a portion of the main body from which the wire projects, to press and bend the wire, so a direction in which the wire projects from the main body is limited to a direction crossing the counter-fitting direction. When the movable member is arranged in the second arrangement and the main body is fitted to an ECU-side connector, the second arrangement is maintained.

36 Claims, 9 Drawing Sheets

(56) References Cited

U.S. PATENT DOCUMENTS

| | | | | |
|---|---|---|---|---|
| 6,755,680 | B2 * | 6/2004 | Okamura et al. | 439/483 |
| 7,180,306 | B2 | 2/2007 | Stanley et al. | |
| 8,070,507 | B1 * | 12/2011 | Liang | 439/446 |
| 2002/0098733 | A1 | 7/2002 | Okamura et al. | |
| 2003/0009273 | A1 | 1/2003 | Stanley et al. | |
| 2004/0041377 | A1 | 3/2004 | Kumakiri et al. | |
| 2007/0159178 | A1 | 7/2007 | Stanley et al. | |
| 2010/0301880 | A1 | 12/2010 | Stanley et al. | |

FOREIGN PATENT DOCUMENTS

| | | |
|---|---|---|
| JP | 11-11256 | 1/1999 |
| JP | 2002-534306 | 10/2002 |
| JP | 2003-203696 | 7/2003 |
| JP | 2004-090717 | 3/2004 |

OTHER PUBLICATIONS

Office action dated Jun. 13, 2013 in corresponding German Application No. 102010037166.1.

* cited by examiner

ELECTRONIC DEVICE WITH A MOVABLE MEMBER THAT BENDS A WIRING AND PREVENTS FITTING OF ANOTHER CONNECTOR IN CERTAIN ARRANGEMENTS

CROSS REFERENCE TO RELATED APPLICATION

This application is based on and incorporates herein by reference Japanese Patent Application No. 2009-208031 filed on Sep. 9, 2009.

BACKGROUND OF THE INVENTION

1. Field of the Invention

The present invention relates to an electronic device including an electronic control unit, a wire, and a connector for electrically connecting the electronic control unit and the wire, a wiring unit including the wire and the connector, and an assembling method for electrically connecting the wire to the electronic control unit.

2. Description of Related Art

Conventionally, attachment of a connector to an end portion of a wire has prevailed to electrically connect the wire to an electronic control unit (ECU) (see, for example, JP-A-2003-203696 corresponding to US2002/0098733A1).

As a result of investigation by the inventor, in an electronic device including the ECU, wire, and the connector, the wire extending from the connector sometimes becomes obstructive for space reasons.

For instance, as illustrated in FIG. 14, an ECU 106 may need to be disposed below a seat 101, and a wire 103 may need to be disposed on the seat 101. In this case, as a method for electrically connecting the wire 103 and the ECU 106, a part of the wire 103 and a connector 105 are guided under the seat 101 through a hole 104 formed in the seat 101, and then, the connector 105 may be fitted to the ECU 106. Additionally, in FIG. 14, a direction perpendicular to a plane of paper corresponds to a front-rear direction of the seat.

When a direction to fit the connector 105 to the ECU 106 is not an upper-lower direction (vertical direction) but a horizontal direction, as illustrated in FIG. 14, the wire 103 extending toward a rear side of the connector 105 (i.e., in an opposite direction from a direction of the fitting) needs to be bent in an upper direction from the horizontal direction. Due to a curve 103*a* formed by itself as a result of this bending, a space 110 under the seat 101 is reduced.

If the wire 103 is bent at the base of the connector 105 beforehand to prevent such a curve 103*a*, the connector 105 and the wire 103 do not easily pass through the hole 104, or the hole 104 needs to be made larger. In the latter case, comfortableness of the seat 101 may deteriorate.

SUMMARY OF THE INVENTION

The present invention addresses at least one of the above disadvantages.

According to the present invention, there is provided an electronic device including an electronic control unit (ECU), a wire, and a wiring side connector. The wire is electrically connected to the ECU. The wiring side connector is attached to an end portion of the wire on an ECU-side to electrically connect the wire and the ECU. The ECU includes an ECU side connector that is fitted to the wiring side connector to electrically connect the wire and the ECU. The wiring side connector includes a wiring side connector main body and a movable member. The wiring side connector main body accommodates the end portion of the wire and is fitted to the ECU side connector. The wire projects from an inside toward an outside of the main body on a surface of the main body that is on an opposite side from a side of the main body on which the main body is fitted to the ECU side connector. The movable member is attached to the main body to be rotatable relative to the main body and includes a restricting member and an extended member. The restricting member has a shape of a plate and restricts a direction in which the wire projects from the main body. The extended member is fixed to the restricting member and extends from the restricting member in a direction that crosses a plate surface of the restricting member. The extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body. When the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector. When the movable member is rotated from the first arrangement to a predetermined second arrangement relative to the main body, the restricting member approaches a portion of the main body, from which the wire projects, to press and bend the wire, so that the direction in which the wire projects from the main body is limited to a direction that crosses the counter-fitting direction. When the movable member is arranged in the second arrangement relative to the main body, and the main body is fitted to the ECU side connector, the second arrangement of the movable member is maintained.

To achieve the objective of the present invention, there is also provided a wiring unit adapted for an electronic control unit (ECU). The wiring unit includes a wire and a wiring side connector. The wire is electrically connected to the ECU. The wiring side connector is attached to an end portion of the wire on an ECU-side to electrically connect the wire and the ECU. The ECU includes an ECU side connector that is fitted to the wiring side connector to electrically connect the wire and the ECU. The wiring side connector includes a wiring side connector main body and a movable member. The wiring side connector main body accommodates the end portion of the wire and is fitted to the ECU side connector. The wire projects from an inside toward an outside of the main body on a surface of the main body that is on an opposite side from a side of the main body on which the main body is fitted to the ECU side connector. The movable member is attached to the main body to be rotatable relative to the main body and includes a restricting member and an extended member. The restricting member has a shape of a plate and restricts a direction in which the wire projects from the main body. The extended member is fixed to the restricting member and extends from the restricting member in a direction that crosses a plate surface of the restricting member. The extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body. When the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector. When the movable member is rotated from the first arrangement to a predetermined second arrangement relative to the main body, the restricting member approaches a portion of the main body, from which the wire projects, to press and bend the wire, so that the direction in which the wire projects from the main body is limited to a direction that crosses the counter-fitting direction. When the movable member is arranged in the second arrangement relative to the main body, and the main body is fitted to the ECU side connector, the second arrangement of the movable member is maintained.

To achieve the objective of the present invention, there is further provided an assembling method for fitting a wiring side connector, which is attached to an end portion of a wire, to an electronic control unit (ECU), so that the wire is electrically connected to the ECU. The ECU includes an ECU side connector that is fitted to the wiring side connector to electrically connect the wire and the ECU. The wire projects from an inside toward an outside of the wiring side connector on a surface of the wiring side connector that is on an opposite side from a side of the wiring side connector on which the wiring side connector is fitted to the ECU side connector. The wiring side connector includes a mechanism that is transformable between a first state and a second state thereof. When the mechanism is arranged in the first state, the mechanism does not prevent the wire from projecting from the wiring side connector to extend straight in a counter-fitting direction, which is directly opposite from a direction in which the wiring side connector is fitted to the ECU side connector. When the mechanism is transformed from the first state to the second state, a direction in which the wire projects from the wiring side connector is limited to a direction that crosses the counter-fitting direction. According to the assembling method, the wiring side connector is passed through a hole formed in a seat, from above the seat in a vertical direction thereof, with the mechanism in the first state. The mechanism is transformed to the second state after the passing of the wiring side connector through the hole. The wiring side connector is fitted to the ECU side connector with the mechanism in the second state, after the transforming of the mechanism to the second state.

To achieve the objective of the present invention, there is additionally provided an assembling method for fitting a wiring side connector, which is attached to an end portion of a wire, to an electronic control unit (ECU), so that the wire is electrically connected to the ECU. The ECU includes an ECU side connector that is fitted to the wiring side connector to electrically connect the wire and the ECU. The wiring side connector includes a wiring side connector main body and a movable member. The wiring side connector main body accommodates the end portion of the wire and is fitted to the ECU side connector. The wire projects from an inside toward an outside of the main body on a surface of the main body that is on an opposite side from a side of the main body on which the main body is fitted to the ECU side connector. The movable member is attached to the main body to be displaceable relative to the main body. When the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector. When the movable member is displaced from the first arrangement to a predetermined second arrangement relative to the main body, the movable member approaches a portion of the main body, from which the wire projects, to press and bend the wire, so that a direction in which the wire projects from the main body is limited to a direction that crosses the counter-fitting direction. When the movable member is arranged in the second arrangement relative to the main body, and the main body is fitted to the ECU side connector, the second arrangement of the movable member is maintained. According to the assembling method, the wiring side connector is passed through a hole formed in a seat, from above the seat in a vertical direction thereof, with the movable member arranged in the first arrangement relative to the main body. The movable member is displaced relative to the main body such that the movable member is arranged in the second arrangement relative to the main body, after the passing of the wiring side connector through the hole. The main body is fitted to the ECU side connector with the movable member arranged in the second arrangement relative to the main body, after the displacing of the movable member.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

An occupant detecting device in accordance with an embodiment of the invention will be described below with reference to FIGS. 1A to 1C. The occupant detecting device, which may correspond to an electronic device, detects only a passenger seat, among the seats (driver seat, passenger seat, and rear seat) in a vehicle. The occupant detecting device detects the types of occupants (i.e., adult or child) seated on the passenger seat by a capacitive sensing method.

Figure 1A:
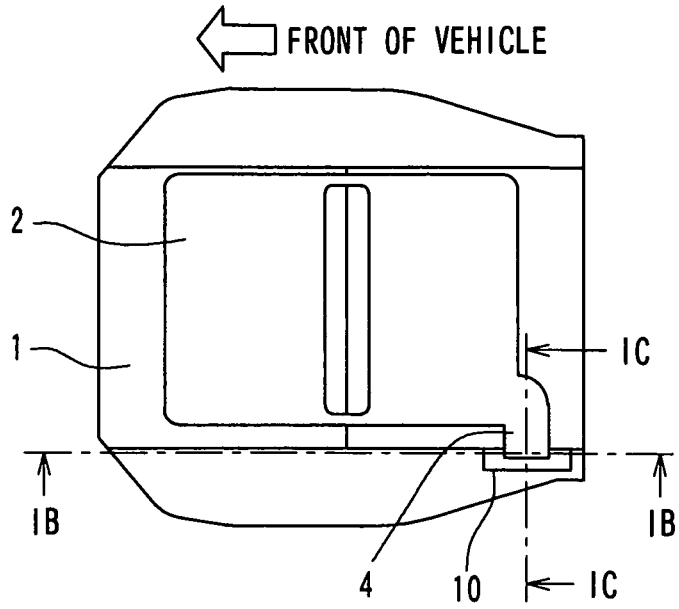
FIG. 1A is a diagram illustrating a configuration of an occupant detecting device in accordance with an embodiment of the invention, at a seat portion of a passenger seat viewed from directly above the seat portion.
Figure 1B:
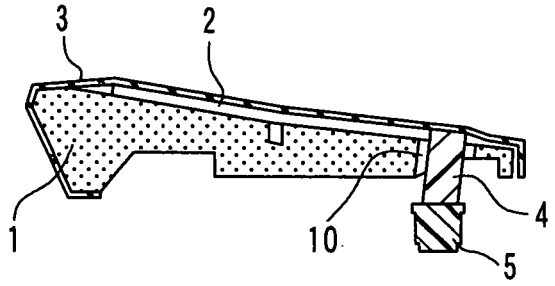
FIG. 1B is a cross-sectional view taken along a line IB-IB in FIG. 1A.
Figure 1C:
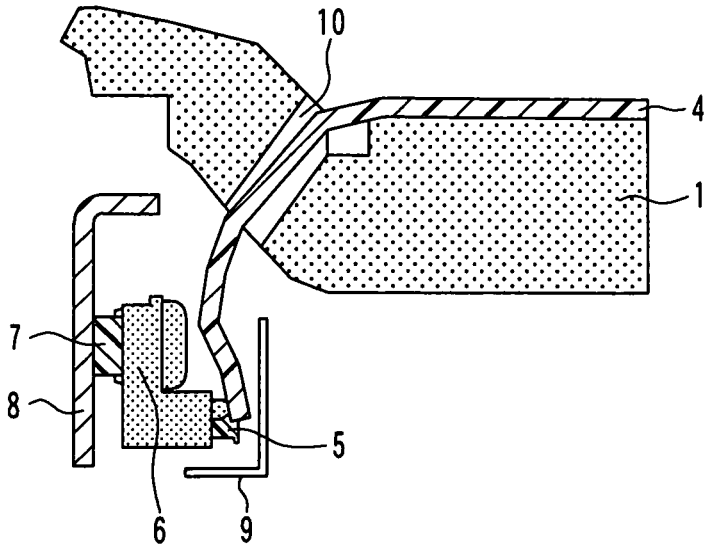
FIG. 1C is a cross-sectional view taken along a line IC-IC in FIG. 1A.

In FIGS. 1A to 1C, the seat portion is a region on which buttocks and thighs of the occupant are located while the occupant is seated. In FIGS. 1A and 1C, drawing of a seat cover 3 on the seat portion is omitted. In the following description, upper, lower, front, rear, right, and left sides are referred to relative to this passenger seat.

The occupant detecting device includes a sensor mat 2 disposed between an upper surface of a seat cushion 1 on the seat portion and the seat cover 3, a wire 4 formed integrally with the sensor mat 2 and extending from an end portion of the sensor mat 2, a wiring side connector 5 attached to an end portion of the wire 4 on its opposite side from the sensor mat 2 (i.e., electronic control unit (ECU) 6-side), and the ECU 6 for occupant detection, to which the wiring side connector 5 is fitted. The wire 4 and the wiring side connector 5 may constitute a wiring unit.

The sensor mat 2 is a member having a circuit for the occupant detection that detects the types of occupants seated on the passenger seat by the capacitive sensing method. The capacitive sensing method means a method for detecting the detection object by detecting a capacitance (or impedance) of the occupant on the seat portion.

Figure 2:
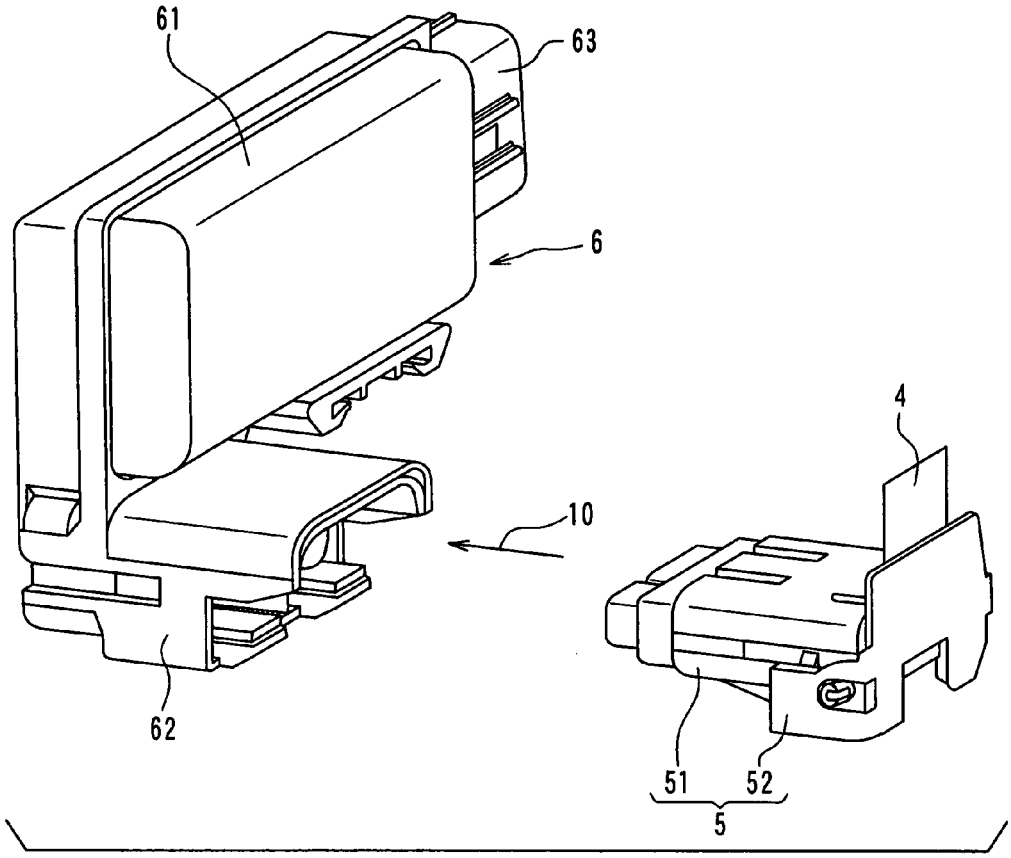
FIG. 2 is a perspective view illustrating a wiring side connector and an electronic control unit (ECU) in accordance with the embodiment.

This sensor mat 2 is attached on the upper surface of the seat cushion 1 using such as a double-stick tape. As illustrated in FIG. 2, the sensor mat 2 is a member having a shape of a generally rectangular film with a hole in a central region of the film. A film such as thin-walled polyethylenenaphthalate (PEN) is employed for a base member of the sensor mat 2. The sensor mat 2 includes a main electrode and a guard electrode, which are not shown, in the film. The main electrode and the guard electrode are metals (e.g., carbon or aluminium) applied to a surface of the base member.

The main electrode is disposed on the surface of the base member. The guard electrode is disposed on the surface of the base member on the opposite side from the main electrode and opposed to the main electrode. Surfaces of the main electrode and the guard electrode are covered in a dielectric member (e.g., thin-walled PEN) not to be in direct contact with a portion of the seat cover 3 except the sensor mat 2.

The wire 4 is a member having a shape of an elongated film and formed integrally with the sensor mat 2. The wire 4 extends from a left end part of the side of the sensor mat 2 on its rear side. The wire 4 passes through a hole 10, which is formed in the corner of the seat cushion 1 at its left rear part in upper and lower directions, from the top to the bottom of the cushion 1. The end portion of the wire 4 on the ECU 6-side is accommodated in the wiring side connector 5, so that the wire 4 is electrically connected to the ECU 6.

Similar to the sensor mat 2, a film such as thin-walled PEN is used for a base member of the wire 4, and metal (e.g., carbon or aluminium) is applied to a surface of the base member. This metal is electrically connected to the main electrode and the guard electrode, and electrically connected further to the ECU 6. Accordingly, the metal electrically connects the main electrode and the ECU 6, and electrically connects the guard electrode and the ECU 6.

The wiring side connector 5 is a member attached to the end portion of the wire 4 on the ECU 6-side and employed for electrically connecting the wire 4 and the ECU 6. More specifically, by fitting the wiring side connector 5, to which the wire 4 is attached, into the ECU 6, the electrical connection between the ECU 6 and a conductive wire of the wire 4 is established, and eventually, an electrical connection between a circuit (i.e., each electrode of the sensor mat 2) which is connected to an end portion of the wire 4 on its opposite side from the ECU 6, and the ECU 6, is made.

The ECU 6 is disposed in a space located directly under the sensor mat 2. More specifically, the ECU 6 is fixed to a sheet frame 8 via a bracket 7 immediately below the hole 10.

The wiring side connector 5 is fitted to the ECU 6, which is fixed in the above-described manner, in the horizontal direction (more specifically, from right side). A direction, in which the wiring side connector 5 is moved when the wiring side connector 5 is fitted to the ECU 6, is hereinafter referred to as a fitting direction, and a direction directly opposite to the fitting direction is hereinafter referred to as a counter-fitting direction (that is directly opposite from a direction in which a wiring side connector main body 51 is fitted to an ECU side connector 62). In this state, the wire 4 extending from the wiring side connector 5 is protected from an object on the opposite side from the ECU 6 (e.g., feet of the occupant on the rear seat) by a protective cover 9.

The ECU 6 includes an internal circuit and a housing accommodating the internal circuit to protect the circuit and made of resin (e.g., polybutylene terephthalate (PBT)). The internal circuit includes an oscillating circuit, which generates high-frequency voltage having a fixed voltage and applied to each electrode of the sensor mat 2, and a current sensing resistor, which detects a current value of a current flowing through each electrode. Based on a result detected by the current sensing resistor, the ECU 6 determines for example, whether the occupant seated on the passenger seat exists, or the types of occupants seated on the passenger seat. The ECU 6 outputs a result of the determination to the other electronic devices such as an air bag ECU (not shown); Based on a signal of the determination result received from the ECU 6, the air bag ECU controls for example, an air bag.

Figure 3:
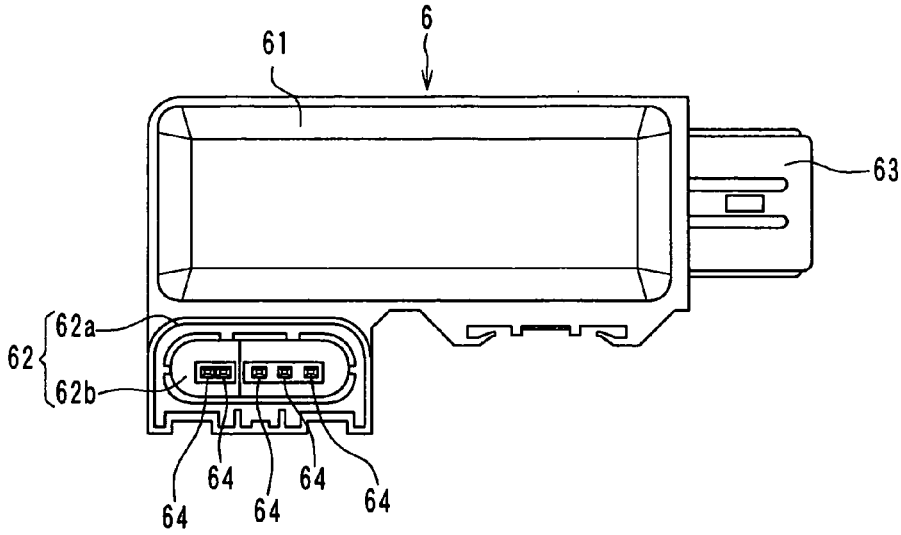
FIG. 3 is a side view illustrating the ECU in accordance with the embodiment.
Figure 4:
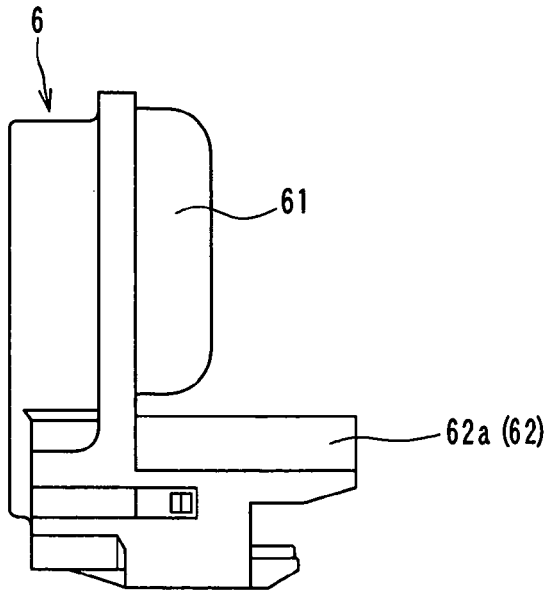
FIG. 4 is a front view illustrating the ECU in accordance with the embodiment.

Detailed structures of the wiring side connector 5 and the ECU 6 will be described below in reference to FIGS. 2 to 8C. The side view of the ECU 6 in FIG. 3 is a diagram viewed from a right-hand side of the seat, and the front view of the ECU 6 in FIG. 4 is a diagram viewed from the rear side of the seat.

The housing of the ECU 6 includes the ECU side connector 62 and an external connection part 63 in addition to a main body part 61 accommodating the internal circuit. The ECU side connector 62 is a member for electrically connecting the wire 4 and the internal circuit of the ECU 6 by being fitted to the wiring side connector 5. The external connection part 63 is a connector member for electrically connecting to the above-described other electronic devices such as an air bag ECU.

The ECU side connector 62 is formed integrally with the main body part 61. The connector 62 is located directly under the main body part 61 with the ECU 6 fixed to the sheet frame 8, and an opening of the connector 62 faces rightward in the horizontal direction. As a result of the above-described configuration of the connector 62, the fitting direction is set at a leftward direction in the horizontal direction.

The ECU side connector 62 includes a sleeve part 62*a* accommodating a part of the wiring side connector 5 when the connector 62 is fitted to the connector 5, and a base part 62*b* provided to close the opening of the end portion of the sleeve part 62*a* in the fitting direction. More than one male terminal 64 (specifically, five male terminals 64) extends from the base part 62*b* into a part of the connector 62 surrounded with the sleeve part 62*a*. This male terminal 64 is electrically connected to the internal circuit of the ECU 6. When the wiring side connector 5 and the ECU side connector 62 are fitted together, the male terminal 64 is electrically connected to the wire 4, which is described in greater detail hereinafter.

A lower part of an end portion of the sleeve part 62*a* in the counter-fitting direction is notched. Accordingly, an upper part (hereinafter referred to as a projection portion) of the end portion of the sleeve part 62*a* in the counter-fitting direction projects further in the counter-fitting direction than the lower part of this end portion of the sleeve part 62*a*.

As illustrated in FIG. 2, the wiring side connector 5 includes the wiring side connector main body 51 made of resin (e.g., PBT), and a movable member 52 made of resin (e.g., PBT). The wiring side connector main body 51 is a portion accommodating an end portion of the wire 4 in the fitting direction and fitted into the ECU side connector 62. The movable member 52 is a separate member from the wiring side connector main body 51, and attached to the main body 51 rotatably relative to the main body 51.

As illustrated in FIGS. 5 to 7C, the wiring side connector main body 51 includes a body portion 51*a*, a fitting hole forming portion 51*b*, two shaft members 51*c*, two claw members 51*d*, and more than one guide member 51*e*. The body portion 51*a*, the fitting hole forming portion 51*b*, the shaft members 51*c*, the claw members 51*d*, and the guide members 51*e* are integrally formed. The body portion 51*a* is a member having a shape of a generally rectangular prism that accommodates the wire 4.

The fitting hole forming portion 51*b* is a member defining more than one hole (specifically, five holes) that communicates between an interior portion and exterior portion of the wiring side connector main body 51, at the end portion of the main body 51 in the fitting direction. When the wiring side connector main body 51 and the ECU side connector 62 are fitted together, the male terminal 64 of the ECU 6 is inserted into this hole, so that the male terminal 64 and the wire 4 are electrically connected.

The shaft member 51*c* is a member having a generally cylindrical shape that extends perpendicularly from each of two particular surfaces of side surfaces of the wiring side connector main body 51 parallel to the fitting direction. These two surfaces face a front-rear direction when the main body 51 and the connector 62 are fitted together. A position on each surface, at which the shaft member 51*c* is provided, is an area of its end portion in the counter-fitting direction that is positioned on the lower side at the time of fitting (i.e., when the wiring side connector main body 51 is fitted into the ECU 6 that is fixed to the sheet frame 8). These two shaft members 51*c* are disposed coaxially with each other. The movable member 52 is engaged with each of the shaft members 51*c*.

The claw member 51*d* is formed on the same surface as the shaft member 51*c* is provided. A function of the shaft member 51*c* will be described in greater detail hereinafter.

The guide member 51*e* is a projection for guiding displacement of the wiring side connector main body 51 when the main body 51 is fitted to the ECU side connector 62. These guide members 51*e* are fitted in grooves formed inside the sleeve part 62*a* of the ECU side connector 62 so as to slide. Accordingly, the movement of the wiring side connector main body 51 is guided. The positions, at which the guide members 51*e* are formed, are on a particular surface of the side surfaces of the wiring side connector main body 51 parallel to the fitting direction that faces downward at the time of fitting.

A hole (not shown) is formed on a surface of the wiring side connector main body 51 in the counter-fitting direction (i.e., opposite side from a portion of the main body 51 fitted to the ECU side connector 62). The wire 4 projects from the interior portion of the wiring side connector main body 51 toward the outside through this hole.

As illustrated in FIGS. 5, 6, and 8A to 8C, the movable member 52 includes a restricting member 52*a* having a flat plate shape, and two extended members 52*b*. The restricting member 52*a* and the extended members 52*b* are integrally formed.

The restricting member 52*a* is a tabular member for restricting a direction in which the wire 4 projects from the wiring side connector main body 51. This restricting member 52*a* is formed in a flat plate shape with a central part of one side of a rectangle having rounded corners notched in a rectangle.

On a surface of the restricting member 52*a* that presses and bends the wire 4, two ridges 52*c*, which are elevated (to be perpendicular to a plate surface of the restricting member 52*a* and to be in contact with the wiring side connector main body 51) compared with the other regions of this surface, are formed. A height of the ridge 52*c* relative to its surrounding area on this surface (i.e., height in a direction perpendicular to the plate surface of the restricting member 52*a*) is larger than a thickness of the wire 4. A distance between the two ridges 52*c* is larger, than a width of the wire 4.

The two extended members 52*b* are members having plate shapes and fixed respectively to two sides adjacent to the particular one side of four sides of the restricting member 52*a* that is notched in a shape of a quadrangle. The extended members 52*b* extend respectively from the restricting member 52*a* in a direction perpendicular to the plate surface of the restricting member 52*a* and in a direction in which the ridges 52*c* are elevated. Accordingly, the two extended members 52*b* are disposed parallel to each other.

The two extended members 52*b* include hole forming portions 52*d* respectively. The shaft member 51*c* of the wiring side connector main body 51 is fitted into each of holes 11 defined by the hole forming portions 52*d*. Accordingly, engagement between the movable member 52 and the wiring side connector main body 51 is achieved. The extended members 52*b* are rigidly rotatable relative to the main body 51 with this engagement part (i.e., shaft member 51*c*) between the movable member 52 and the main body 51 serving as a rotation axis. Accordingly, the extended members 52*b* and the restricting member 52*a* are made rigidly rotatable together in synchronization relative to the main body 51. In addition, this rotation axis is perpendicular to the fitting direction (and the counter-fitting direction).

By such a rotation mechanism of the movable member 52, the wiring side connector 5 can be transformed between two states of different relative arrangements of the movable member 52 with respect to the wiring side connector main body 51. A first state of the two states may be a state illustrated in FIG. 5, and a second state of the two states may be a state illustrated in FIG. 6.

More specifically, in the first state, the plate surface of the restricting member 52*a* is parallel to the counter-fitting direction, and a direction, in which the extended members 52*b* extend from the restricting member 52*a*, is perpendicular to the counter-fitting direction. Such an arrangement of the movable member 52 relative to the wiring side connector main body 51 is hereinafter referred to as a first arrangement. As above, the plate surface of the restricting member 52*a* is parallel to the counter-fitting direction, and the extended members 52*b* rotate only at a surface of the main body 51 from which the wire 4 does not project. Accordingly, in the first state, the movable member 52 is located not to hinder the projecting of the wire 4 from the main body 51 or the straight extension of the wire 4 in the counter-fitting direction, as illustrated in FIG. 5.

Figure 5:
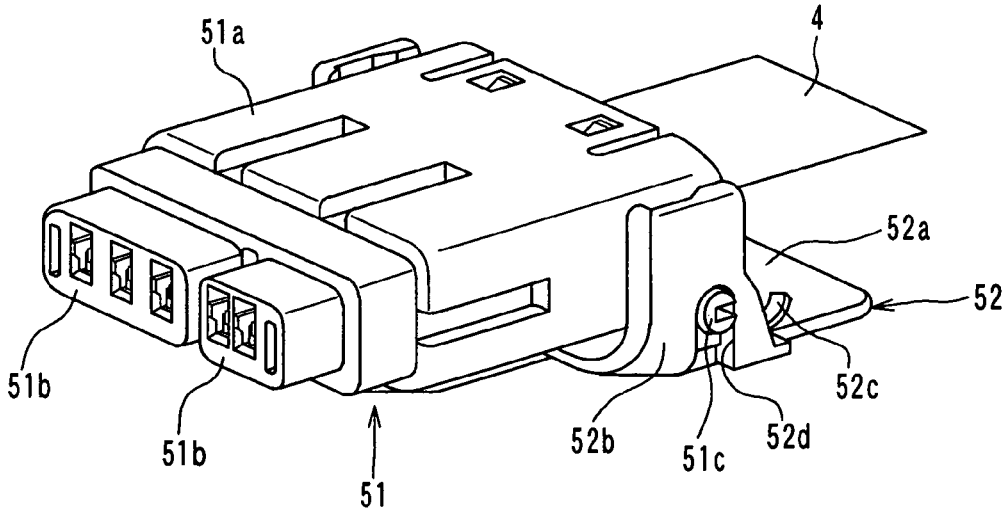
FIG. 5 is a perspective view illustrating a wiring side connector main body and a movable member in a first state in accordance with the embodiment.
Figure 6:
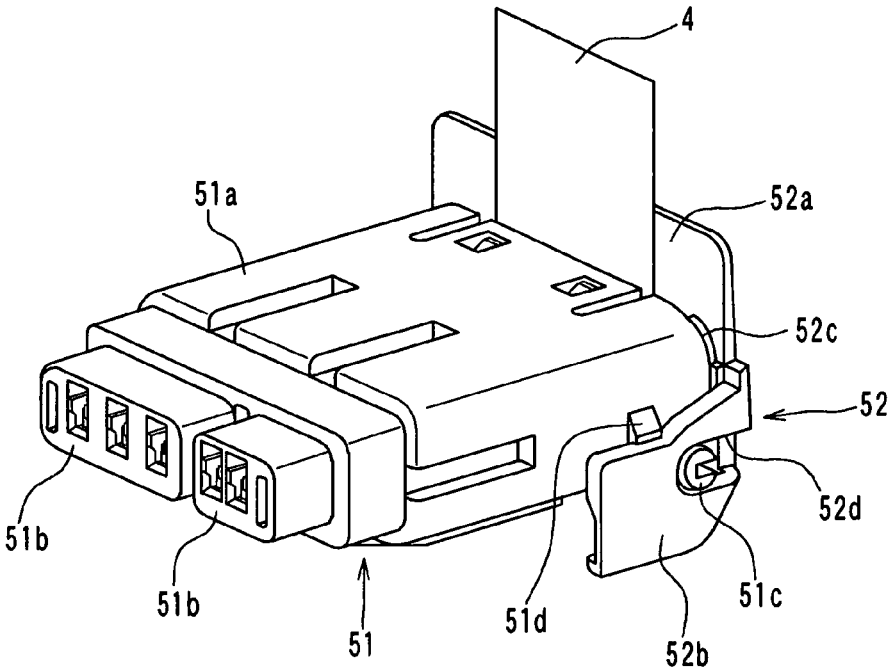
FIG. 6 is a perspective view illustrating the wiring side connector main body and the movable member in a second state in accordance with the embodiment.
Figure 7C:
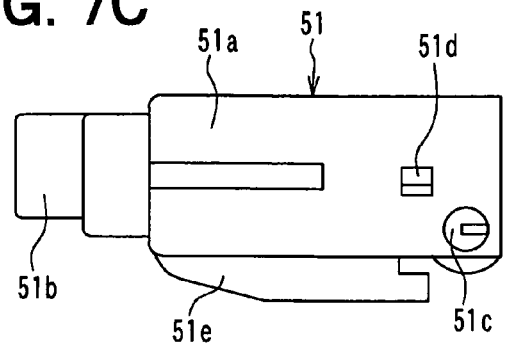
FIG. 7C is a diagram of the three-view diagram illustrating the wiring side connector main body viewed from an upper side of FIG. 7B.
Figure 7A:
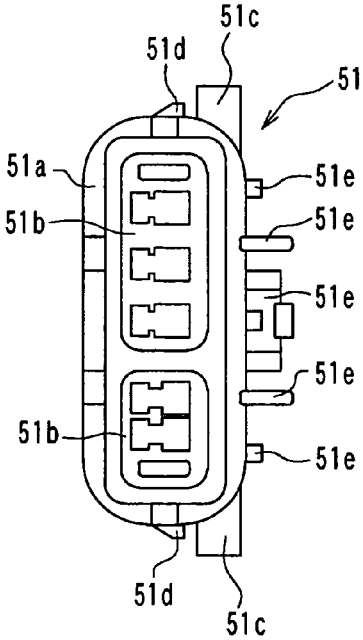
FIG. 7A is a diagram of a three-view diagram illustrating the wiring side connector main body viewed from a fitting direction in accordance with the embodiment.
Figure 7B:
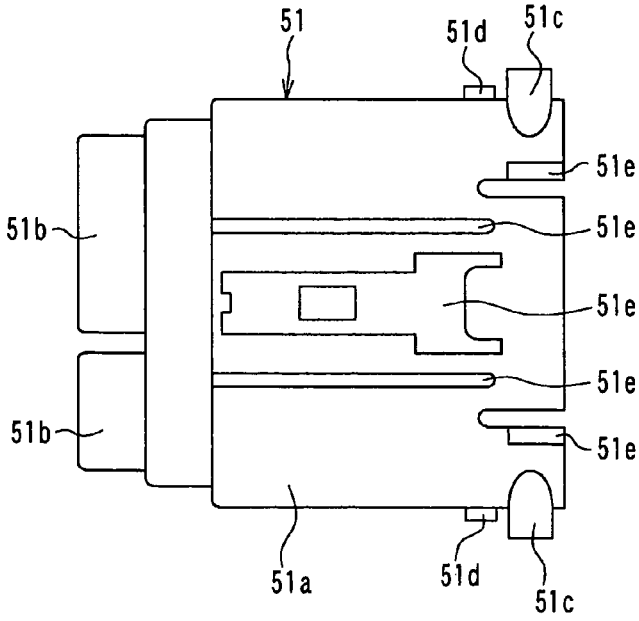
FIG. 7B is a diagram of the three-view diagram illustrating the wiring side connector main body viewed from a right side of FIG. 7A.
Figure 8C:
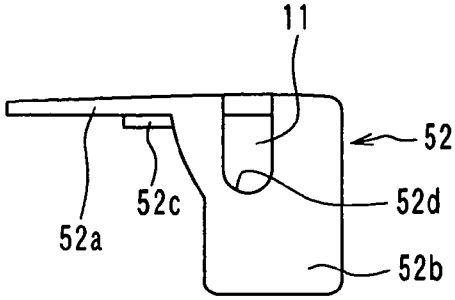
FIG. 8C is a diagram of the three-view diagram illustrating the movable member viewed from an upper side of FIG. 8A.
Figure 8A:
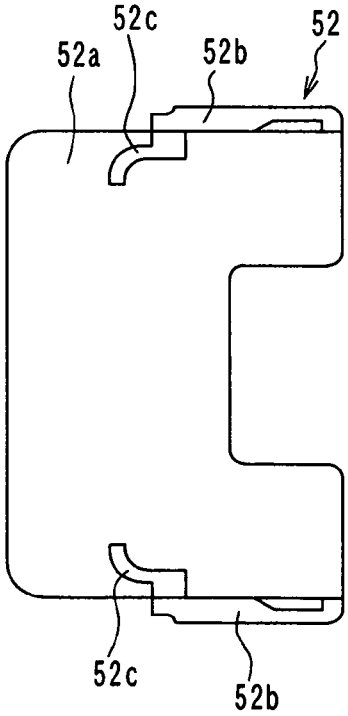
FIG. 8A is a diagram of a three-view diagram illustrating the movable member in accordance with the embodiment.
Figure 8B:
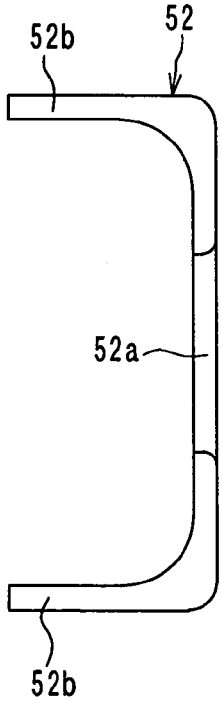
FIG. 8B is a diagram of the three-view diagram illustrating the movable member viewed from a right side of FIG. 8A.

When the movable member 52 rotates relative to the wiring side connector main body 51 from the first arrangement to a second arrangement, i.e., when the wiring side connector 5 is transformed from the first state in FIG. 5 to the second state in FIG. 6, the restricting member 52*a* moves toward a portion of the main body 51 from which the wire 4 projects. As a result, the wire 4 is pressed and bent by the restricting member 52*a* so that a direction, in which the wire 4 projects from the main body 51, is limited to a direction perpendicular to the counter-fitting direction. Moreover, the direction, in which the extended members 52*b* extend from the restricting member 52*a*, is the same direction as the fitting direction.

In this second state, the ridges 52*c* are in contact with the surface of the wiring side connector main body 51 from which the wire 4 projects. As above, when the movable member 52 is in the second arrangement relative to the main body 51, the ridges 52*c* are in contact with the surface of the main body 51 from which the wire 4 projects. Accordingly, a space that is larger than the thickness of the wire 4 is defined between this surface and the ridges 52*c*. Therefore, the wire 4 is disposed in this space, and a possibility that a strong stress is applied to the wire 4 between the restricting member 52*a* and the main body 51 is reduced. As a result, a possibility of damage to the wire 4 is reduced.

In this second state, the movable member 52 further projects in the direction perpendicular to the counter-fitting direction than the wiring side connector main body 51. As a result of the projection of the restricting member 52*a* in a direction in which the wire 4 is pressed and bent, the direction of projection of the wire 4 is even more surely restricted. Thus, a larger space is ensured under the seat.

When the movable member 52 is located in the second arrangement, the claw members 51*d* are engaged with the respective extended members 52*b*, so that the movable member 52 is prevented from being brought back to the first arrangement. Consequently, when the movable member 52 is in the second arrangement relative to the wiring side connector main body 51, this second arrangement is maintained. However, by applying force to separate the extended members 52*b* from the main body 51 to elastically deform the extended members 52*b* slightly, and then by rotating the movable member 52 with this state retained, the movable member 52 is brought back to the first arrangement.

Next, a method for attachment of the occupant detecting device having the above-described configuration to the seat (specifically, the passenger seat) and immediately under the passenger seat (more specifically, assembling method for electrically connecting the wire 4 to the ECU 6 by fitting the wiring side connector 5, which is attached to the end portion of the wire 4, to the ECU 6) will be described below. When the ECU 6 is disposed below the seat; the wiring side connector 5 and the wire 4 are guided from above the seat to under the seat through the hole 10 formed in the seat; and then the connector 5 is fitted to the ECU 6, decrease of a space under the seat is limited, and increase of a size of the hole 10 is restricted by employing the following procedures.

Firstly, as a first process, the ECU 6 is fixed to the sheet frame 8 via the bracket 7 by such as a screw, as illustrated in FIG. 1C. Meanwhile, as described above, the ECU 6 is fixed to the frame 8 such that the ECU 6 is located directly under the passenger seat as well as directly under the hole 10 and the fitting direction coincides with the leftward direction. As a second process, the sensor mat 2 is attached on the upper surface of the seat cushion 1 by such as a double-stick tape, as illustrated in FIG. 1A.

Figure 9:
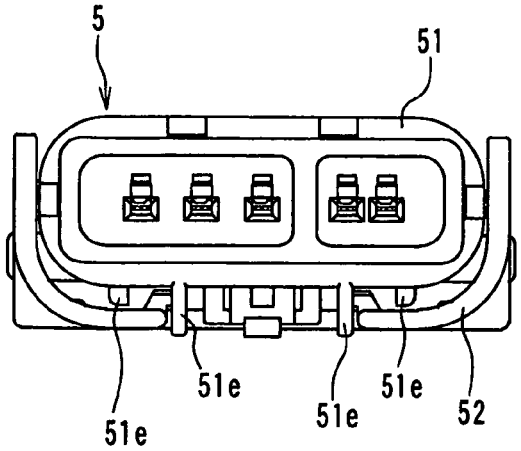
FIG. 9 is a front view illustrating the wiring side connector in the first state viewed from the fitting direction in accordance with the embodiment.
Figure 10:
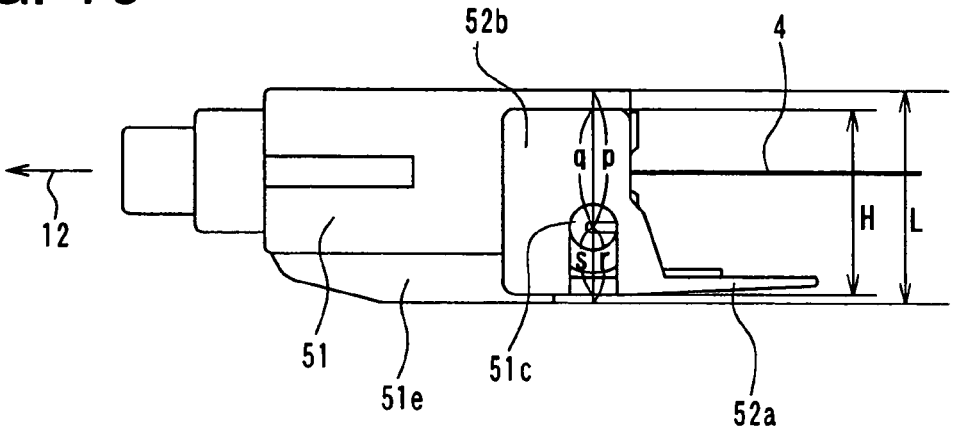
FIG. 10 is a side view illustrating the wiring side connector in the first state viewed from a right side of FIG. 9 in accordance with the embodiment.

Next, as a third process, the movable member 52 is set in the first arrangement relative to the wiring side connector main body 51, as illustrated in FIGS. 9 and 10.

Meanwhile, as illustrated in FIG. 10, in a direction of the movable member 52 that is perpendicular to the shaft member 51*c* as well as to the counter-fitting direction 12 (hereinafter referred to simply as a thickness direction), a range H, in which the extended members 52*b* exist, falls within a range L, in which the wiring side connector main body 51 exists. The range H in the thickness direction, in which the extended members 52*b* exist, means a range of a projected image of the movable member 52 in the counter-fitting direction 12 in the thickness direction. The range L, in which the main body 51 exists, means a range of a projected image of the main body 51 in the counter-fitting direction 12 in the thickness direction.

A first reason for the above-described relationship between the ranges H, L is explained as follows. Given that an upper direction in FIG. 10 parallel to the thickness direction is a forward thickness direction, and that a lower direction in FIG. 10 parallel to the thickness direction is a reverse thickness direction, in the first state, a length q from the rotation center of the shaft member 51*c* to an end portion of the extended member 52*b* along a first direction parallel to the forward thickness direction is shorter than a length p along the forward thickness direction from a rotation center of the shaft member 51*c* to an end portion of the wiring side connector main body 51.

A second reason for the above-described relationship is explained as follows. In the first state, a length s along the reverse thickness direction from the rotation center of the shaft member 51*c* to an end portion of the extended member 52*b* is shorter than a length r from the rotation center of the shaft member 51*c* to an end portion of the wiring side connector main body 51 along the reverse thickness direction. To this end, as described above, the notch is formed in the restricting member 52*a* such that the guide members 51*e* and the restricting member 52*a* do not obstruct each other in the first state.

Then, as a fourth process, the wiring side connector 5 is passed through the hole 10 formed in the seat from above the seat, while the connector 5 is in the first state. In this case, the movable member 52 does not prevent the projecting of the wire 4 from the main body 51 or the straight extension of the wire 4 in the counter-fitting direction. Accordingly, since when the connector 5 is passed through the hole 10 from the end portion of the connector 5 in the fitting direction, the wire 4 passes through the hole 10 after the connector 5, it is only necessary for the hole 10 to have such a size that the connector 5 passes easily through the hole 10. As a result, increase of the size of the hole 10 is limited.

When the movable member 52 is located in the first arrangement, in the direction that is perpendicular to the shaft member 51*c* as well as to the counter-fitting direction, the size of the movable member 52 is smaller than the size Of the wiring side connector main body 51, and in the thickness direction, the range in which the movable member 52 exists falls within the range in which the main body 51 exists. Accordingly, a possibility that the movable member 52 becomes obstructive in passing the wiring side connector 5 through the hole 10 on the seat is further reduced.

Figure 11:
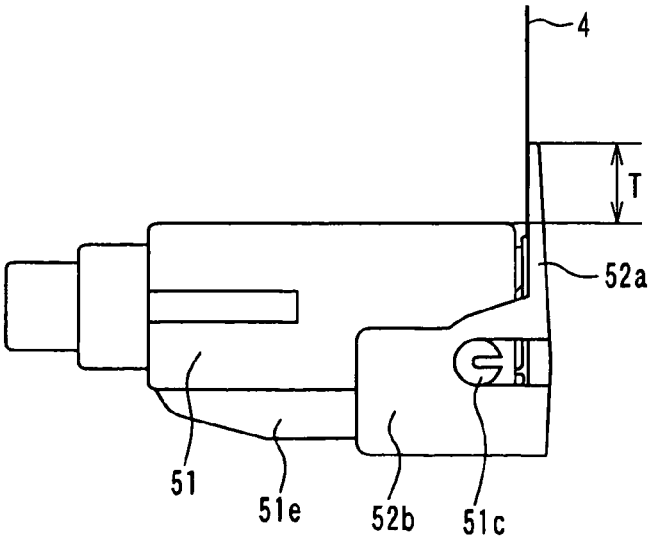
FIG. 11 is a side view illustrating the wiring side connector in the second state in accordance with the embodiment.

Subsequently, as a fifth process, after the wiring side connector 5 passes through the hole 10, as illustrated in FIG. 11, the movable member 52 is rotated around the shaft member 51*c* (relative to the wiring side connector main body 51) such that the wiring side connector 5 (movable member 52 relative to the main body 51) becomes in the second state (i.e., the movable member 52 is displaced). Accordingly, the wire 4 is pressed and bent by the restricting member 52*a* so that a direction, in which the wire 4 projects from the main body 51, is limited to a direction perpendicular to the counter-fitting direction.

As a sixth process, while the wiring side connector 5 is in the second state, the wiring side connector main body 51 is fitted into the ECU side connector 62 to set the main body 51 at a regular position. Then, the protective cover 9 is fixed (relative to a body of the vehicle) at a position slightly away from the connector 5 in the counter-fitting direction.

The regular position of the wiring side connector main body 51 means a position, at which the main body 51 cannot be moved any further in the fitting direction as a result of the contact of the wiring side connector main body 51 with the ECU side connector 62.

Meanwhile, as illustrated in FIG. 1C, the wire 4 is bent (by the restricting member 52*a*) forcibly upward, i.e., in a direction of the hole 10 (A direction in which the wire 4 projects from the wiring side connector main body 51 is limited to a direction that crosses the counter-fitting direction). Thus, the amount of a curve of a path of the wire 4 is reduced (compared to the case of projection of the wire 4 in the counter-fitting direction), and the protective cover 9 is accordingly disposed closer to the ECU 6. As a result, decrease of the space below the passenger seat is alleviated.

Figure 12:
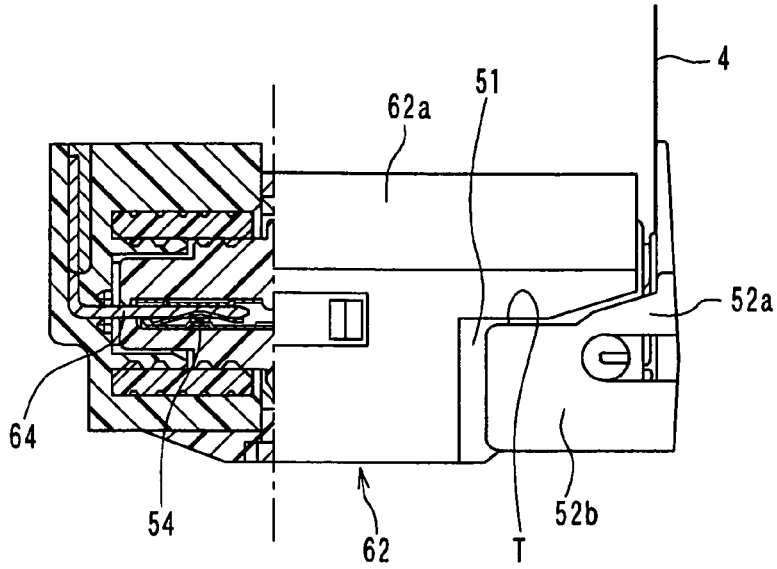
FIG. 12 is a partial cross sectional view illustrating a state in which the wiring side connector is fitted to an ECU side connector in the second state in accordance with the embodiment.

FIG. 12 illustrates that the wiring side connector 5 in the second state is inserted in the ECU side connector 62 so that the connector 5 is fitted in the connector 62 at the regular position. In FIG. 12, a part of the components on the left side of an alternate long and short dash line is shown in section. As illustrated in FIG. 12, in the second state, the extended members 52*b* are disposed in the second arrangement. By fitting the extended member 52*b* into the notch of the sleeve part 62*a*, the connectors 5, 62 are fitted together such that the sleeve part 62*a* and the extended member 52*b* do not obstruct each other. When the connectors 5, 62 are fitted together, the male terminal 64 of the ECU 6, and a female terminal 54, which is fixed in the wiring side connector main body 51 and electrically connected to the wire 4, are electrically connected. Accordingly, the wire 4 and the internal circuit of the ECU 6 are electrically connected.

In a state in which such fitting is achieved, the movable member 52 is held in the second arrangement. A first reason therefor is that, as described above, the second arrangement is maintained by the claw members 51*d*. A second reason is that, in the second state, the extended member 52*b* and a lower end of the projection portion of the sleeve part 62*a* are in contact at a position T. Accordingly, even if the movable member 52 is made to rotate so as to be in an arrangement other than the second arrangement, the sleeve part 62*a* serves as an obstruction to prevent the rotation of the movable member 52. Therefore, the movable member 52 cannot be rotated.

Consequently, when the movable member 52 is located in the second arrangement relative to the wiring side connector main body 51, and the main body 51 is fitted in the ECU side connector 62, the movable member 52 cannot rotate from the second arrangement. As a result, the second arrangement is stably retained. Thus, an effect of limiting decrease of the space under the seat lasts after the fitting.

When the movable member 52 is located in the second arrangement relative to the wiring side connector main body 51, and the ECU side connector 62 is fitted to the connector 5, the second arrangement of the movable member 52 is maintained.

The extended members 52*b* extend from the restricting member 52*a* in a direction to intersect with the plate surface of the restricting member 52*a*. The extended members 52*b* are engaged with the wiring side connector main body 51. The extended members 52*b* are rigidly rotatable relative to the main body 51 with the engagement part between the main body 51 and the extended members 52*b* serving as a rotation axis. Accordingly, the extended members 52*b* and the restricting member 52*a* are rigidly rotatable together, with respect to the main body 51.

Figure 14:
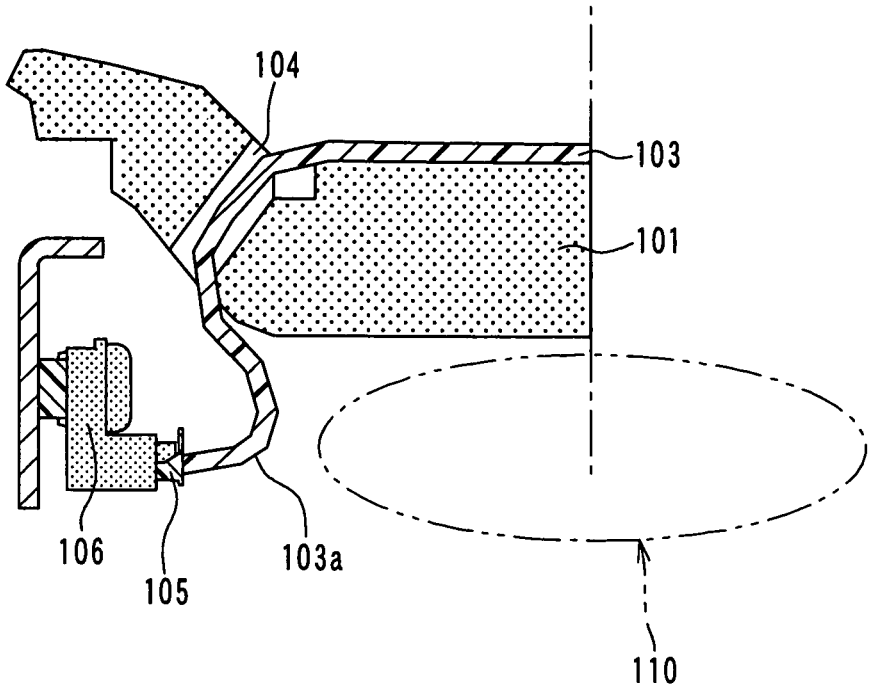
FIG. 14 RELATED ART
FIG. 14 is a diagram illustrating an example of attachment of an electronic device to a seat in accordance with a related technology.

As above, the movable member 52 is engaged with the wiring side connector main body 51, and rigidly rotated. Accordingly, the configuration of the wiring side connector 5 for making the movable member 52 rotatable relative to the main body 51 is simple and durable compared to the employment of, for example, a bendable flexible member (i.e., the member between a body portion 52 and a locking piece 54 in FIGS. 14 and 15 in JP-A-2003-203696) for a part of the movable member 52.

In addition, when the wiring side connector 5 is not in the second state, the wiring side connector main body 51 cannot be fitted to the ECU side connector 62, and the wire 4 and the internal circuit of the ECU 6 cannot be electrically connected, either.

Figure 13:
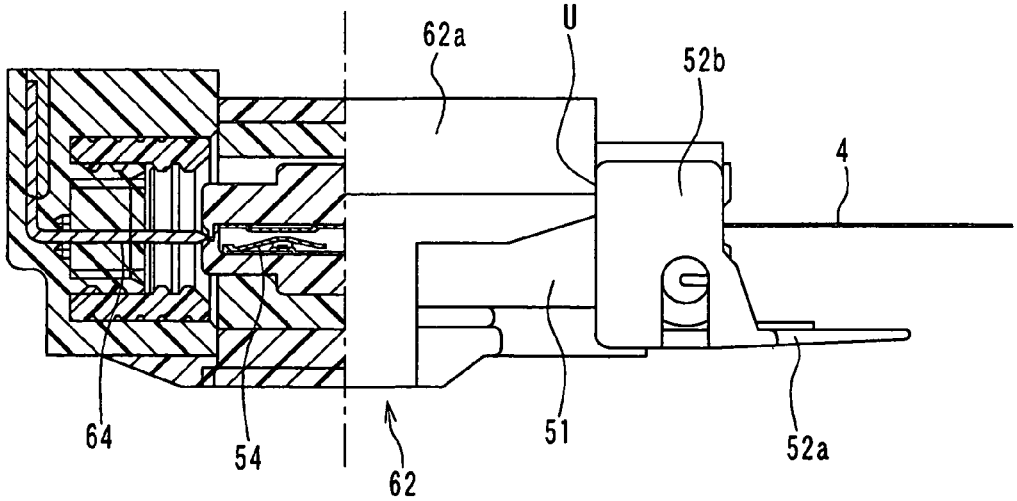
FIG. 13 is a partial cross sectional view illustrating a state in which the wiring side connector is fitted to the ECU side connector in the first state in accordance with the embodiment.

To illustrate the above, the case of insertion of the wiring side connector 5 in the first state into the ECU side connector 62 so as to fit the connector 5 to the ECU side connector 62 will be described below with reference to FIG. 13. In FIG. 13 as well, the part of the components on the left side of an alternate long and short dash line is shown in section.

As illustrated in FIG. 13, when the movable member 52 is not disposed in the second arrangement but in the first arrangement relative to the wiring side connector main body 51, the extended members 52*b* and a right end of the projection portion of the sleeve part 62*a* (i.e., end portion of the sleeve part 62*a* in the counter-fitting direction) are in abutment with each other at a position U, so that the fitting of the main body 51 and the ECU side connector 62 is prevented. This is because the length of the extended member 52*b* in the second state in the thickness direction is longer than the length of the extended member 52*b* in the first state in the thickness direction.

Accordingly, as long as the movable member 52 is not disposed in the second arrangement relative to the wiring side connector main body 51, the main body 51 and the ECU side connector 62 are not fitted together. Therefore, an operator does not fit together the main body 51 and the connector 62. In a state in which he or she has forgotten to set the movable member 52 in the second arrangement. Hence, at the time of the attachment between the main body 51 and the connector 62, a possibility that the operator has forgotten to dispose the movable member 52 in the second arrangement, i.e., to limit the direction of the wire 4 to a direction that crosses the counter-fitting direction by pressing and bending the wire 4 by the restricting member 52*a*, is reduced.

In the state of FIG. 13, the male terminal 64 and the female terminal 54 are not in contact. Accordingly, the electrical connection between the wire 4 and the internal circuit of the ECU 6 is also prevented. This is because a distance from an end portion (i.e., position U) of the extended member 52*b* in the first state in the fitting direction to an end portion of the female terminal 54 in the fitting direction is shorter than a distance from an end portion (i.e., position U) of the projection portion of the sleeve part 62*a* in the first state in the counter-fitting direction to an end portion of the male terminal 64 in the counter-fitting direction.

Accordingly, as long as the movable member 52 is not disposed in the second arrangement relative to the wiring side connector main body 51, the wire 4 and the internal circuit of the ECU 6 are not electrically connected. Therefore, even if the operator has forgotten to dispose the movable member 52 in the second arrangement at the time of the attachment, he or she notices that the wire 4 and the internal circuit of the ECU 6 are not electrically connected in subsequently checking the electrical connection. In a process of searching for the cause thereof, he or she discovers that the movable member 52 is not disposed in the second arrangement.

Modifications of the above embodiment will be described below. The embodiment of the invention has been described above. The scope of the invention is not limited to the above-described embodiment alone, and the scope of the invention encompasses various embodiments that can fulfill a function of each feature of the invention.

For example, in the second state, the direction, in which the wire 4 projects from the main body 51 is not necessarily limited to the direction perpendicular to the counter-fitting direction, and this direction may be limited to a direction that simply crosses the counter-fitting direction. In such a case as well, a certain space is secured.

The movable member 52 does not necessarily rotate, as long as the movable member 52 is movable relative to the main body 51 and the movable member 52 is displaceable between the first state and the second state.

In the above embodiment, the extended member 52*b* extends from the restricting member 52*a* in the direction perpendicular to the plate surface of the restricting member 52*a*. Alternatively, the direction of extension of the extended member 52*b* is not necessarily limited to the direction perpendicular to the plate surface of the restricting member 52*a*, as long as it is the direction to intersect with the plate surface of the restricting member 52*a*.

A place for installation of the occupant detecting device is not only the passenger seat but also the driver seat or the rear seat. A space under the driver seat is a space into which feet of an occupant seated on the rear seat directly behind the driver seat enter. Therefore, a larger space may preferably be secured under the driver seat. A space under the rear seat sometimes serves as a storage space for baggage. Thus, in that case, a larger space may preferably be secured under the rear seat.

The rotation axis of the extended members 52*b* is not necessarily perpendicular to the counter-fitting direction. The rotation axis of the extended members 52*b* may be non-parallel with respect to the counter-fitting direction.

The rotation axis of the extended members 52*b* may be provided for the extended member 52*b* itself instead of the main body 51. In that case, a recess for shaft bearings may be formed on the main body 51.

In the above embodiment, as an example of the electronic device of the invention, the occupant detecting device using the capacitive sensing method is employed. However, the electronic device of the invention is not limited to such a detecting device. The electronic device may be employed for an occupant detecting device using a method other than the capacitive sensing method. Alternatively, the electronic device may be used for a seating sensor for detecting whether an occupant is seated on the seat that includes a pressure-sensitive sensor provided at the seat portion of the seat.

The seat, which is an object for the attachment of the electronic device of the invention, is not necessarily a seat of a vehicle. For example, the seat which is the object for the attachment may be a seat in a marine vessel or an airplane. Alternatively, the seat that is the attachment object may be a seat in a movie theater. In the marine vessel, airplane, or movie theater, more than one seat is arranged in a front-back direction thereof. If the electronic device is provided under a front seat of two seats disposed in the front-back direction, a large space for feet of a person seated on a rear seat is ensured. Even if the electronic device is disposed under a seat with no seat therebehind, a space such as a place for baggage is securable under the seat.

Additional advantages and modifications will readily occur to those skilled in the art. The invention in its broader terms is therefore not limited to the specific details, representative apparatus, and illustrative examples shown and described.

What is claimed is:

1. An electronic device comprising:

an electronic control unit (ECU);

a wire that is electrically connected to the ECU; and a wiring side connector that is attached to an end portion of the wire on an ECU-side to electrically connect the wire and the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be rotatable relative to the main body and that includes:

a restricting member having a shape of a plate and restricting a direction in which the wire projects from the main body; and an extended member fixed to the restricting member and extending from the restricting member in a direction that crosses a plate surface of the restricting member;

the extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is rotated from the first arrangement to a predetermined second arrangement relative to the main body, a portion of the restricting member directly engaging the wire moves closer to a portion of the main body from which the wire projects to press and bend the wire, so that the direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained;

the wire is restricted to a direction of rotation of the movable member;

the ECU side connector includes a sleeve part that accommodates the main body when the ECU side connector is fitted to the main body; and when the movable member is not arranged in the second arrangement relative to the main body, the extended member and the sleeve part are in contact, so that the fitting of the ECU side connector to the main body is prevented.

2. The electronic device according to claim 1, wherein:

the ECU side connector includes a sleeve part that accommodates the main body when the ECU side connector is fitted to the main body; and when the movable member is arranged in the second arrangement relative to the main body, and the main body is fitted to the ECU side connector, the sleeve part obstructs the rotation of the extended member relative to the main body.

3. The electronic device according to claim 1, wherein:

the rotation axis of the rotation of the extended member is perpendicular to the counter-fitting direction; and when the movable member is arranged in the first arrangement relative to the main body, a range in which the movable member exists falls within a range in which the main body exists in a direction that is perpendicular to the rotation axis as well as to the counter-fitting direction.

4. The electronic device according to claim 1, wherein:

the movable member further includes a ridge on a surface of the restricting member, on which the restricting member presses and bends the wire;

the ridge is elevated compared with the other region of the surface of the restricting member;

a height of the ridge in a direction that is perpendicular to the plate surface of the restricting member relative to the surface of the restricting member surrounding the ridge is greater than a thickness of the wire; and when the movable member is arranged in the second arrangement relative to the main body, the ridge is in contact with a surface of the main body, from which the wire projects.

5. The electronic device according to claim 1, wherein when the movable member is arranged in the second arrangement relative to the main body, the restricting member projects further than the main body in a direction that is perpendicular to the rotation axis of the rotation of the extended member as well as to the counter-fitting direction.

6. The electronic device according to claim 1, wherein when the movable member is arranged in the second arrangement relative to the main body, a direction in which the wire is bent by the restricting member is a direction that is perpendicular to the counter-fitting direction.

7. The electronic device according to claim 1, wherein the wire is a film wiring that includes a wiring pattern formed on a film.

8. The electronic device according to claim 1, wherein the electronic device is disposed below a front seat of two seats, which are arranged such that the front seat is located on a front side of the other seat of the two seats.

9. The electronic device according to claim 1, wherein the ECU is disposed below a seat of a vehicle.

10. The electronic device according to claim 1, wherein the device is adapted for a vehicle, the device further comprising a circuit for occupant detection at the other end portion of the wire located on an opposite side from the ECU-side, the circuit being configured to detect a type of an occupant seated on a seat of the vehicle.

11. The electronic device according to claim 10, wherein the circuit is configured to detect the type of the occupant by means of a capacitive sensing method.

12. The electronic device according to claim 1, wherein the device is adapted for a vehicle, the device further comprising a circuit for seating detection at the other end portion of the wire located on an opposite side from the ECU-side, wherein the circuit is configured to detect an occupant being seated on a seat of the vehicle.

13. The electronic device according to claim 1, wherein the wire is clamped between the restricting member and the wiring side connector main body in the second arrangement so that the direction of the wire is restricted.

14. The electronic device according to claim 1, wherein an end portion of the movable member projects further than an end face of the wiring side connector main body in the second arrangement.

15. The electronic device according to claim 1, wherein a length of the extended member in a thickness direction that is perpendicular to the counter-fitting direction and to the rotation axis in the first arrangement is larger than a length of the extended member in the thickness direction in the second arrangement.

16. The electronic device according to claim 15, wherein when the movable member is not arranged in the second arrangement relative to the main body, the extended member and the sleeve part are in contact, so that the electrical connection between the wire and the ECU is prevented.

17. A wiring unit adapted for an electronic control unit (ECU), the wiring unit comprising:

a wire that is electrically connected to the ECU; and a wiring side connector that is attached to an end portion of the wire on an ECU-side to electrically connect the wire and the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be rotatable relative to the main body and that includes:

a restricting member having a shape of a plate and restricting a direction in which the wire projects from the main body; and an extended member fixed to the restricting member and extending from the restricting member in a direction that crosses a plate surface of the restricting member;

the extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is rotated from the first arrangement to a predetermined second arrangement relative to the main body, a portion of the restricting member directly engaging the wire moves closer to a portion of the main body from which the wire projects to press and bend the wire, so that the direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

the ECU side connector includes a sleeve part that accommodates the main body when the ECU side connector is fitted to the main body; and when the movable member is not arranged in the second arrangement relative to the main body, the extended member and the sleeve part are in contact, so that the fitting of the ECU side connector to the main body is prevented.

18. The wiring unit according to claim 17, wherein the wire is clamped between the restricting member and the wiring side connector main body in the second arrangement so that the direction of the wire is restricted.

19. The wiring unit according to claim 17, wherein an end portion of the movable member projects further than an end face of the wiring side connector main body in the second arrangement.

20. The wiring unit according to claim 17, wherein a length of the extended member in a thickness direction that is perpendicular to the counter-fitting direction and to the rotation axis in the first arrangement is larger than a length of the extended member in the thickness direction in the second arrangement.

21. An assembling method for fitting a wiring side connector, which is attached to an end portion of a wire, to an electronic control unit (ECU), so that the wire is electrically connected to the ECU, wherein:

the ECU includes an ECU side connector that is fitted to the wiring side connector to electrically connect the wire and the ECU;

the wire projects from an inside toward an outside of the wiring side connector on a surface of the wiring side connector that is on an opposite side from a side of the wiring side connector on which the wiring side connector is fitted to the ECU side connector;

the wiring side connector includes a mechanism that is transformable between a first state and a second state thereof;

when the mechanism is arranged in the first state, the mechanism does not prevent the wire from projecting from the wiring side connector to extend straight in a counter-fitting direction, which is directly opposite from a direction in which the wiring side connector is fitted to the ECU side connector;

when the mechanism is transformed from the first state to the second state, a portion of the mechanism directly engaging the wire moves closer to the surface of the wiring side connector and a direction in which the wire projects from the wiring side connector is limited to a direction that crosses the counter-fitting direction; and the wire is restricted to a direction of rotation of the movable member;

the ECU side connector includes a sleeve part that accommodates the wiring side connector when the ECU side connector is fitted to the wiring side connector; and when the mechanism is not arranged in the second state, the wiring side connector and the sleeve part are in contact, so that the fitting of the ECU side connector to the wiring side connector is prevented;

the method comprising:

passing the wiring side connector through a hole formed in a seat, from above the seat in a vertical direction thereof, with the mechanism in the first state;

transforming the mechanism to the second state after the passing of the wiring side connector through the hole; and fitting the wiring side connector to the ECU side connector with the mechanism in the second state, after the transforming of the mechanism to the second state.

22. The assembling method according to claim 21, wherein the wire is clamped between the surface of the wiring side connector and the mechanism in the second state so that the direction of the wire is restricted.

23. The assembling method according to claim 21, wherein an end portion of the mechanism projects further than the surface of the wiring side connector in the second state.

24. The assembling method according to claim 21, wherein:

the mechanism includes:

a restricting member having a shape of a plate and restricting a direction in which the wire projects from the wiring side connector; and an extended member fixed to the restricting member and extending from the restricting member in a direction that crosses a plate surface of the restricting member; and a length of the extended member in a thickness direction that is perpendicular to the counter-fitting direction and to a rotation axis of rotation of the extended member in the first state is larger than a length of the extended member in the thickness direction in the second state.

25. An assembling method for fitting a wiring side connector, which is attached to an end portion of a wire, to an electronic control unit (ECU), so that the wire is electrically connected to the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be displaceable relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is displaced from the first arrangement to a predetermined second arrangement relative to the main body, a portion of the movable member directly engaging the wire moves closer to a portion of the main body from which the wire projects to press and bend the wire, so that a direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

the ECU side connector includes a sleeve part that accommodates the main body when the ECU side connector is fitted to the main body; and when the movable member is not arranged in the second arrangement relative to the main body, the wiring side connector and the sleeve part are in contact, so that the fitting of the ECU side connector to the main body is prevented, the method comprising:

passing the wiring side connector through a hole formed in a seat, from above the seat in a vertical direction thereof, with the movable member arranged in the first arrangement relative to the main body;

displacing the movable member relative to the main body such that the movable member is arranged in the second arrangement relative to the main body, after the passing of the wiring side connector through the hole; and fitting the main body to the ECU side connector with the movable member arranged in the second arrangement relative to the main body, after the displacing of the movable member.

26. The assembling method according to claim 25, wherein the wire is clamped between the movable member and the wiring side connector main body in the second arrangement so that the direction of the wire is restricted.

27. The assembling method according to claim 25, wherein an end portion of the movable member projects further than an end face of the wiring side connector main body in the second arrangement.

28. The assembling method according to claim 25, wherein:

the movable member includes:

a restricting member having a shape of a plate and restricting a direction in which the wire projects from the main body; and an extended member fixed to the restricting member and extending from the restricting member in a direction that crosses a plate surface of the restricting member; and a length of the extended member in a thickness direction that is perpendicular to the counter-fitting direction and to a rotation axis of rotation of the extended member in the first arrangement is larger than a length of the extended member in the thickness direction in the second arrangement.

29. An electronic device comprising:

an electronic control unit (ECU);

a wire that is electrically connected to the ECU; and a wiring side connector that is attached to an end portion of the wire on an ECU-side to electrically connect the wire and the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be rotatable relative to the main body and that includes:

a restricting member having a shape of a plate and restricting a direction in which the wire projects from the main body; and an extended member fixed to the restricting member and extending from the restricting member in a direction that crosses a plate surface of the restricting member;

the extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is rotated from the first arrangement to a predetermined second arrangement relative to the main body, a portion of the restricting member directly engaging the wire moves closer to a portion of the main body from which the wire projects to press and bend the wire, so that the direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

wherein a length of the extended member in a thickness direction that is perpendicular to the counter-fitting direction and to the rotation axis in the first arrangement is larger than a length of the extended member in the thickness direction in the second arrangement.

30. An electronic device comprising:

an electronic control unit (ECU);

a wire that is electrically connected to the ECU; and a wiring side connector that is attached to an end portion of the wire on an ECU-side to electrically connect the wire and the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be rotatable relative to the main body and that includes:

a restricting member having a shape of a plate and restricting a direction in which the wire projects from the main body; and an extended member fixed to the restricting member and extending from the restricting member in a direction that crosses a plate surface of the restricting member;

the extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is rotated from the first arrangement to a predetermined second arrangement relative to the main body, a portion of the restricting member directly engaging the wire moves closer to a portion of the main body from which the wire projects to press and bend the wire, so that the direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

wherein a length of the extended member in a thickness direction that is perpendicular to the counter-fitting direction and to the rotation axis in the first arrangement is larger than a length of the extended member in the thickness direction in the second arrangement.

31. An electronic device comprising:

an electronic control unit (ECU);

a wire that is electrically connected to the ECU; and a wiring side connector that is attached to an end portion of the wire on an ECU-side to electrically connect the wire and the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be rotatable relative to the main body and that includes:

a restricting member having a shape of a plate and restricting a direction in which the wire projects from the main body; and an extended member fixed to the restricting member and extending from the restricting member in a direction that crosses a plate surface of the restricting member;

the extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is rotated from the first arrangement to a predetermined second arrangement relative to the main body, a portion of the restricting member directly engaging the wire moves closer to a portion of the main body from which the wire projects to press and bend the wire, so that the direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

wherein:

the mechanism includes:

a restricting member having a shape of a plate and restricting a direction in which the wire projects from the wiring side connector; and an extended member fixed to the restricting member and extending from the restricting member in a direction that crosses a plate surface of the restricting member; and a length of the extended member in a thickness direction that is perpendicular to the counter-fitting direction and to a rotation axis of rotation of the extended member in the first state is larger than a length of the extended member in the thickness direction in the second state.

32. An electronic device comprising:

an electronic control unit (ECU);

a wire that is electrically connected to the ECU; and a wiring side connector that is attached to an end portion of the wire on an ECU-side to electrically connect the wire and the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be rotatable relative to the main body and that includes:

a restricting member having a shape of a plate and restricting a direction in which the wire projects from the main body; and an extended member fixed to the restricting member and extending from the restricting member in a direction that crosses a plate surface of the restricting member;

the extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is rotated from the first arrangement to a predetermined second arrangement relative to the main body, a portion of the restricting member directly engaging the wire moves closer to a portion of the main body from which the wire projects to press and bend the wire, so that the direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

wherein:

the movable member includes:

a restricting member having a shape of a plate and restricting a direction in which the wire projects from the main body; and an extended member fixed to the restricting member and extending from the restricting member in a direction that crosses a plate surface of the restricting member; and a length of the extended member in a thickness direction that is perpendicular to the counter-fitting direction and to a rotation axis of rotation of the extended member in the first arrangement is larger than a length of the extended member in the thickness direction in the second arrangement.

33. An electronic device comprising:

an electronic control unit (ECU);

a wire that is electrically connected to the ECU; and a wiring side connector that is attached to an end portion of the wire on an ECU-side to electrically connect the wire and the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be rotatable relative to the main body and that includes:

a restricting member having a shape of a plate and restricting a direction in which the wire projects from the main body; and an extended member fixed to the restricting member and extending from the restricting member in a direction that crosses a plate surface of the restricting member;

the extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is rotated from the first arrangement to a predetermined second arrangement relative to the main body, a portion of the restricting member directly engaging the wire moves closer to a portion of the main body from which the wire projects to press and bend the wire, so that the direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

wherein the wire is clamped between the restricting member and the wiring side connector main body in the second arrangement so that the direction of the wire is restricted.

34. A wiring unit adapted for an electronic control unit (ECU), the wiring unit comprising:

a wire that is electrically connected to the ECU; and a wiring side connector that is attached to an end portion of the wire on an ECU-side to electrically connect the wire and the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be rotatable relative to the main body and that includes:

a restricting member having a shape of a plate and restricting a direction in which the wire projects from the main body; and an extended member fixed to the restricting member and extending from the restricting member in a direction that crosses a plate surface of the restricting member;

the extended member is engaged with the main body, such that the extended member is rigidly rotatable relative to the main body with an engagement part between the main body and the extended member serving as a rotation axis of the rotation of the extended member and that the extended member and the restricting member are thereby rigidly rotatable together relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is rotated from the first arrangement to a predetermined second arrangement relative to the main body, the restricting member moves closer to a portion of the main body, from which the wire projects, to press and bend the wire, so that the direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

wherein the wire is clamped between the restricting member and the wiring side connector main body in the second arrangement so that the direction of the wire is restricted.

35. An assembling method for fitting a wiring side connector, which is attached to an end portion of a wire, to an electronic control unit (ECU), so that the wire is electrically connected to the ECU, wherein:

the ECU includes an ECU side connector that is fitted to the wiring side connector to electrically connect the wire and the ECU;

the wire projects from an inside toward an outside of the wiring side connector on a surface of the wiring side connector that is on an opposite side from a side of the wiring side connector on which the wiring side connector is fitted to the ECU side connector;

the wiring side connector includes a mechanism that is transformable between a first state and a second state thereof;

when the mechanism is arranged in the first state, the mechanism does not prevent the wire from projecting from the wiring side connector to extend straight in a counter-fitting direction, which is directly opposite from a direction in which the wiring side connector is fitted to the ECU side connector;

when the mechanism is transformed from the first state to the second state, the mechanism moves closer to the surface of the wiring side connector and a direction in which the wire projects from the wiring side connector is limited to a direction that crosses the counter-fitting direction; and the wire is restricted to a direction of rotation of the movable member;

the method comprising:

passing the wiring side connector through a hole formed in a seat, from above the seat in a vertical direction thereof, with the mechanism in the first state;

transforming the mechanism to the second state after the passing of the wiring side connector through the hole; and fitting the wiring side connector to the ECU side connector with the mechanism in the second state, after the transforming of the mechanism to the second state;

wherein the wire is clamped between the surface of the wiring side connector and the mechanism in the second state so that the direction of the wire is restricted.

36. An assembling method for fitting a wiring side connector, which is attached to an end portion of a wire, to an electronic control unit (ECU), so that the wire is electrically connected to the ECU, wherein:

the ECU includes an ECU side connector that is fitted to the wiring side connector to electrically connect the wire and the ECU;

the wiring side connector includes:

a wiring side connector main body that accommodates the end portion of the wire and is fitted to the ECU side connector, the wire projecting from an inside toward an outside of the main body on a surface of the main body that is on an opposite side from a side of the main body on which the main body is fitted to the ECU side connector; and a movable member that is attached to the main body to be displaceable relative to the main body;

when the movable member is arranged in a predetermined first arrangement relative to the main body, the movable member is in a position in which the movable member does not prevent the wire from projecting from the main body to extend straight in a counter-fitting direction, which is directly opposite from a direction in which the main body is fitted to the ECU side connector;

when the movable member is displaced from the first arrangement to a predetermined second arrangement relative to the main body, the movable member moves closer to a portion of the main body, from which the wire projects, to press and bend the wire, so that a direction in which the wire projects from the main body is limited to a direction that crosses the counter-fitting direction;

when the movable member is arranged in the second arrangement relative to the main body, and the main body is fitted to the ECU side connector, the second arrangement of the movable member is maintained; and the wire is restricted to a direction of rotation of the movable member;

the method comprising:

passing the wiring side connector through a hole formed in a seat, from above the seat in a vertical direction thereof, with the movable member arranged in the first arrangement relative to the main body;

displacing the movable member relative to the main body such that the movable member is arranged in the second arrangement relative to the main body, after the passing of the wiring side connector through the hole; and fitting the main body to the ECU side connector with the movable member arranged in the second arrangement relative to the main body, after the displacing of the movable member;

wherein the wire is clamped between the movable member and the wiring side connector main body in the second arrangement so that the direction of the wire is restricted.

* * * * *